US009742158B2

(12) United States Patent
Suzuki

(10) Patent No.: US 9,742,158 B2
(45) Date of Patent: Aug. 22, 2017

(54) SPARK PLUG

(71) Applicant: NGK SPARK PLUG CO., LTD., Nagoya-shi, Aichi (JP)

(72) Inventor: Kaori Suzuki, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/105,864

(22) PCT Filed: Dec. 8, 2014

(86) PCT No.: PCT/JP2014/006112

§ 371 (c)(1),
(2) Date: Jun. 17, 2016

(87) PCT Pub. No.: WO2015/098007

PCT Pub. Date: Jul. 2, 2015

(65) Prior Publication Data

US 2017/0033540 A1 Feb. 2, 2017

(30) Foreign Application Priority Data

Dec. 26, 2013 (JP) ..... 2013-269190

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
None
See application file for complete search history.

(56) References Cited

U.S. PATENT DOCUMENTS 5,440,198 A * 8/1995 Oshima ..... H01T 21/02 313/141
2007/0069618 A1* 3/2007 Havard ..... H01T 13/20 313/141

(Continued)

FOREIGN PATENT DOCUMENTS

JP 2010-238498 A 10/2010 ..... H01T 13/20
WO WO 2012/042801 A1 4/2012 ..... H01T 13/32

OTHER PUBLICATIONS

International Search Report issued in corresponding International Patent Application No. PCT/JP2014/006112, dated Jan. 13, 2015.

*Primary Examiner* — Ashok Patel
(74) *Attorney, Agent, or Firm* — Kusner & Jaffe

(57) ABSTRACT

Disclosed is a spark plug with improved lifetime. The spark plug includes a first electrode and a second electrode having an electrode base and an electrode tip joined to the electrode base with a gap defined between the first electrode and the electrode tip. The electrode tip has a flat surface located apart from the electrode base and is joined to the electrode base at a side opposite to the flat surface by laser welding with emission of laser beam in a plane direction from one to the other end of the flat surface. A fused part is formed by the laser welding at the opposite side of the electrode tip. A cross-sectional shape of the fused part taken along a plane perpendicular to the flat surface and parallel to the plane direction has a constricted section at a position from one side to the other side in the plane direction.

9 Claims, 14 Drawing Sheets

(56) References Cited

U.S. PATENT DOCUMENTS

| | | | | |
|---|---|---|---|---|
| 2008/0238282 | A1* | 10/2008 | Kato | H01T 13/32 313/142 |
| 2012/0019120 | A1 | 1/2012 | Nakayama et al. | 313/141 |
| 2013/0069516 | A1* | 3/2013 | Sumoyama | C22C 5/04 313/141 |
| 2013/0200773 | A1 | 8/2013 | Sakayanagi et al. | 313/141 |

* cited by examiner

FIG. 4

| Sample | Welding condition | Depression | A/B ×100 | Crack | Oxide scale |
|---|---|---|---|---|---|
| A1 | condition 1 | formed | — | not occurred | 32% |
| A2 | ↑ | ↑ | — | occurred | 44% |
| A3 | ↑ | ↑ | — | occurred | 65% |
| A4 | ↑ | ↑ | — | not occurred | 40% |
| A5 | ↑ | ↑ | — | occurred | 69% |
| B1 | condition 2 | ↑ | — | occurred | 24% |
| B2 | ↑ | ↑ | — | occurred | 15% |
| B3 | ↑ | ↑ | — | not occurred | 9% |
| B4 | ↑ | ↑ | — | not occurred | 12% |
| B5 | ↑ | ↑ | — | not occurred | 14% |
| C1 | condition 3 | not formed | 71% | not occurred | 22% |
| C2 | ↑ | ↑ | 85% | ↑ | 15% |
| C3 | ↑ | ↑ | 69% | ↑ | 19% |
| C4 | ↑ | ↑ | 81% | ↑ | 18% |
| C5 | ↑ | ↑ | 74% | ↑ | 15% |
| D1 | condition 4 | ↑ | 66% | ↑ | 12% |
| D2 | ↑ | ↑ | 67% | ↑ | 10% |
| D3 | ↑ | ↑ | 63% | ↑ | 17% |
| D4 | ↑ | ↑ | 79% | ↑ | 10% |
| D5 | ↑ | ↑ | 70% | ↑ | 13% |
| E1 | condition 5 | ↑ | 53% | ↑ | 17% |
| E2 | ↑ | ↑ | 48% | ↑ | 20% |
| E3 | ↑ | ↑ | 50% | ↑ | 15% |
| E4 | ↑ | ↑ | 50% | ↑ | 16% |
| E5 | ↑ | ↑ | 49% | ↑ | 15% |
| F1 | condition 6 | ↑ | 32% | ↑ | 48% |
| F2 | ↑ | ↑ | 42% | ↑ | 38% |
| F3 | ↑ | ↑ | 40% | ↑ | 47% |
| F4 | ↑ | ↑ | 40% | ↑ | 41% |
| F5 | ↑ | ↑ | 37% | ↑ | 50% |

| Sample | Welding condition | Depression | A/B ×100 | Crack | Oxide scale |
|---|---|---|---|---|---|
| G1 | condition 7 | formed | — | occurred | 70% |
| G2 | ↑ | ↑ | — | occurred | 53% |
| G3 | ↑ | ↑ | — | occurred | 65% |
| H1 | condition 8 | ↑ | — | not occurred | 50% |
| H2 | ↑ | ↑ | — | not occurred | 44% |
| H3 | ↑ | ↑ | — | occurred | 49% |
| I1 | condition 9 | not formed | 69% | not occurred | 19% |
| I2 | ↑ | ↑ | 77% | ↑ | 25% |
| I3 | ↑ | ↑ | 75% | ↑ | 22% |
| J1 | condition 10 | ↑ | 63% | ↑ | 11% |
| J2 | ↑ | ↑ | 65% | ↑ | 16% |
| J3 | ↑ | ↑ | 67% | ↑ | 12% |
| K1 | condition 11 | ↑ | 51% | ↑ | 20% |
| K2 | ↑ | ↑ | 55% | ↑ | 17% |
| K3 | ↑ | ↑ | 50% | ↑ | 19% |
| L1 | condition 12 | ↑ | 44% | ↑ | 31% |
| L2 | ↑ | ↑ | 35% | ↑ | 40% |
| L3 | ↑ | ↑ | 40% | ↑ | 42% |

SPARK PLUG

RELATED APPLICATIONS

This application is a National Stage of International Application No. PCT/JP2014/006112 filed Dec. 8, 2014, which claims the benefit of Japanese Patent Application No. 2013-269190 filed Dec. 26, 2013.

FIELD OF THE INVENTION

The present invention relates to a spark plug.

BACKGROUND OF THE INVENTION

A spark plug is known, in which an electrode tip is joined to an electrode base for improvement in electrode durability (see, for example, Japanese Laid-Open Patent Publication No. 2010-238498). In this type of spark plug, the electrode tip is formed of a material having higher spark resistance and oxidation resistance to those of the electrode base. As such an electrode tip material, a noble metal (e.g. platinum, iridium, ruthenium or rhodium) or a material containing a noble metal can be used as a main component.

The spark plug of Japanese Laid-Open Patent Publication No. 2010-238498 includes a fused part formed by laser welding between the electrode tip and the electrode base such that the fused part has a tapered shape (so called "wedge shape") in the emission direction of a laser beam during the laser welding.

When the spark plug is used in an internal combustion engine, thermal stress is exerted on the fused part between the electrode tip and the electrode base by combustion heat of the internal combustion engine. It is thus likely that a crack (fracture) and an oxide scale will occur at boundaries between the electrode tip and the fused part and between the electrode base and the fused part. In the case where at least one of a crack and an oxide scale is developed excessively at such boundaries, the electrode tip may become separated and fall off from the electrode base.

There is no sufficient consideration given in Japanese Laid-Open Patent Publication No. 2010-238498 to the improvement in the lifetime of the spark plug by retarding the development of a crack and an oxide scale at the boundaries between the electrode tip and the fused part and between the electrode base and the fused part.

SUMMARY OF THE INVENTION

The present invention has been made to solve the above-mentioned problems and can be embodied by the following configurations.

(1) In accordance with a first aspect of the present invention, there is provided a spark plug, comprising:

a first electrode; and a second electrode including an electrode base and an electrode tip joined to the electrode base so as to define a gap between the first electrode and the electrode tip, wherein the electrode tip has a flat surface located apart from the electrode base and is joined to the electrode base at a side of the electrode tip opposite to the flat surface by laser welding with emission of a laser beam in a plane direction from one end to the other end of the flat surface;

wherein the spark plug comprises a fused part formed by the laser welding at the opposite side of the electrode tip; and wherein a cross-sectional shape of the fused part taken along a plane perpendicular to the flat surface and parallel to the plane direction has a constricted section at a position from one side to the other side in the plane direction.

The presence of the constricted section in the fused part makes it possible to prevent the occurrence of a crack at boundaries of the fused part. As compared to the case where the cross-sectional shape of the fused part has no constricted section, the presence of the constricted section in the fused part leads to longer lengths of the boundaries between the electrode tip and the fused part and between the electrode base and the fused part and thus makes it possible to, even when at least one of a crack and an oxide scale occur at the boundaries, suppress the development of such a crack or oxide scale such that the electrode tip does not become separated and fall off from the electrode base. Accordingly, it is possible to improve the lifetime of the spark plug.

(2) In accordance with a second aspect of the present invention, there is provided a spark plug as described above, wherein the fused part has an exposed surface to which the laser beam is emitted and satisfies a relationship of $A/B \geq 0.5$ where A is a minimum width of the cross-sectional shape in a direction perpendicular to the plane direction as measured at the constricted section; and B is a maximum width of the cross-sectional shape in the direction perpendicular to the plane direction as measured at a point further apart from the exposed surface than a point of the constricted section at which the minimum width A is measured.

It is possible in this configuration to effectively suppress the oxide scale from being developed due to the concentration of stress on the constricted section.

(3) In accordance with a third aspect of the present invention, there is provided a spark plug as described above, wherein the fused tip has an exposed surface to which the laser beam is emitted; and at least one point of the constricted section at which the cross-sectional shape has a minimum width in a direction perpendicular to the plane direction is located closer to the exposed surface than an imaginary line which divides a length of the cross-sectional shape in the plane direction into two equal halves.

It is possible in this configuration to effectively suppress the crack and oxide scale from being developed from the exposed surface.

(4) In accordance with a fourth aspect of the present invention, there is provided a spark plug as described above, wherein the electrode tip has an opposing surface facing the first electrode with the gap defined between the opposing surface and the first electrode; and the fused part is formed avoiding the opposing surface.

It is possible in this configuration to prevent a starting point of the crack and oxide scale from being formed in the fused part by the generation of a spark discharge in the gap.

(5) In accordance with a fifth aspect of the present invention, there is provided a spark plug as described above, wherein the fused part has an exposed surface to which the laser beam is emitted; and a center of gravity of the cross-sectional shape is located closer to the exposed surface than an imaginary line which divides a length of the cross-sectional shape in the plane direction into two equal halves.

It is possible in this configuration to suppress the development of the crack and oxide scale at the fused part even when the fused part is biased in volume toward the exposed surface.

(6) In accordance with a sixth aspect of the present invention, there is provided a spark plug as described above, wherein the second electrode may be at least one of a center electrode and a ground electrode.

It is possible in this configuration to improve the lifetime of the spark plug in which the electrode tip is joined to at least one of the center electrode and the ground electrode.

It is possible to embody the present invention in various forms including, not only a spark plug, but also an electrode of a spark plug, a manufacturing method of a spark plug, a manufacturing device of a spark plug, a computer program for controlling such a manufacturing device and a non-transitory storage media for storing such a computer program.

BRIEF DESCRIPTION OF THE DRAWINGS

FIG. 4 is a table showing the results of durability evaluation test of the spark plug.

DETAILED DESCRIPTION OF THE PREFERRED EMBODIMENTS

A. First Embodiment

Figure 1:
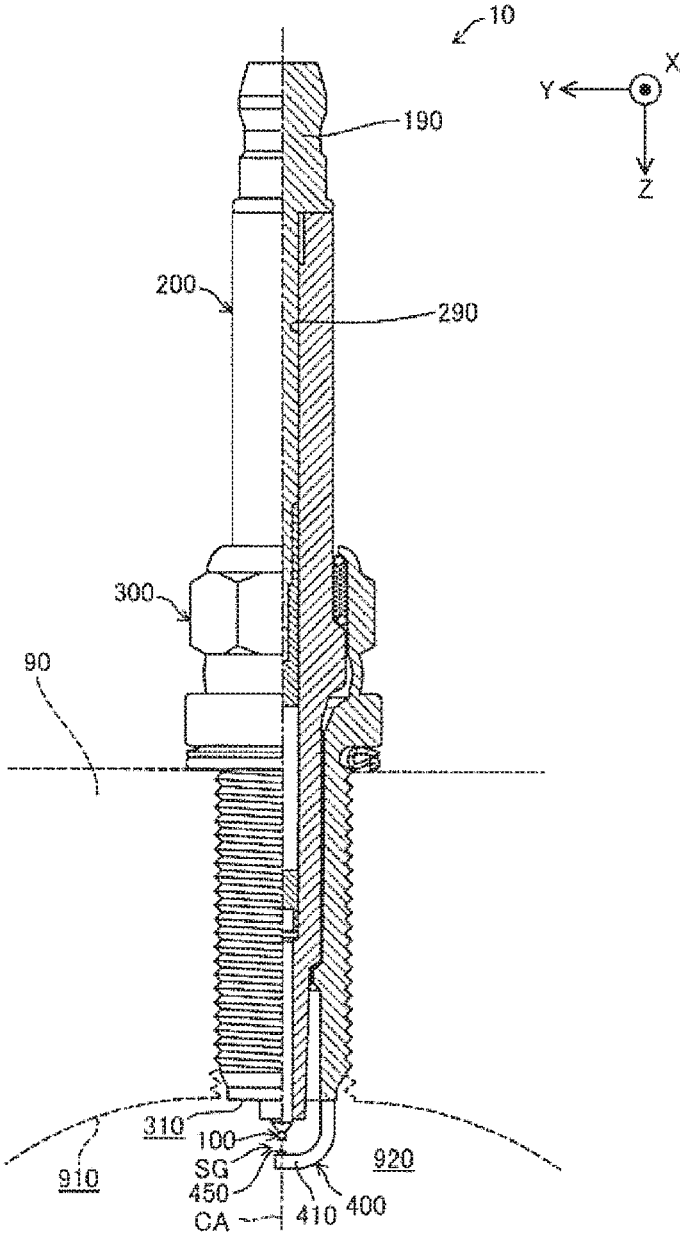
FIG. 1 is a schematic view, partially in section, of a spark plug according a first embodiment of the present invention.

FIG. 1 is a schematic view, partially in section, of a spark plug 10 according a first embodiment of the present invention. In FIG. 1, an axis of the spark plug 10 is designated by CA. The left side of the axis CA in FIG. 1 shows an appearance of the spark plug 10, whereas the right side of the axis CA in FIG. 1 shows a cross section of the spark plug 10. In the following description, the bottom and top sides of FIG. 1 are referred to as front and rear sides of the spark plug 10, respectively.

The spark plug 10 includes a center electrode 100, an insulator 200, a metal shell 300 and a ground electrode 400. In the first embodiment, the axis CA of the spark plug 10 is in agreement with axes of the center electrode 100, the insulator 200 and the metal shell 300.

In a front end side of the spark plug 10, there is a gap SG defined between the center electrode 100 and the ground electrode 400. The gap SG of the spark plug 10 is called a spark gap. The spark plug 10 is adapted for mounting on an internal combustion engine 90 with the front end side of the spark plug 10, in which the gap SG is defined, protruding from an inner wall 910 of a combustion chamber 920 of the internal combustion engine. The spark plug 10 generates a spark discharge with the application of a high voltage (e.g. ten to thirty thousand volts) to the center electrode 100 in a state where the spark plug 10 is mounted to the internal combustion engine 90. The spark discharge generated in the gap SG causes ignition of air-fuel mixture in the combustion chamber 920.

In FIG. 1, mutually perpendicular X, Y and Z axes are shown. The X, Y and Z axes of FIG. 1 corresponds to those of the other drawings.

Among the X, Y and Z axes of FIG. 1, the X axis is an axis perpendicular to the Y and Z axes. The +X axis direction is defined as a direction from the back to front side along the X axis in FIG. 1. The −X axis direction is defined as a direction opposite to the +X-axis direction.

Among the X, Y and Z axes of FIG. 1, the Y axis is an axis perpendicular to the X and Z axes. The +Y axis direction is defined as a direction from the right to left side along the Y axis in FIG. 1. The −Y axis direction is defined as a direction opposite to the +Y axis direction.

Among the X, Y and Z axes of FIG. 1, the Y axis is an axis parallel to the axis CA. The +Z axis direction is defined as a direction from the rear to front side of the spark plug 10 along the Y axis (axis CA) in FIG. 1. The −Z axis direction is defined as a direction opposite to the +Z axis direction.

The center electrode 100 of the spark plug 10 is a first electrode with electrical conduction properties. The center electrode 100 has a rod shape along the axis CA. In the first embodiment, the center electrode 100 is formed of a nickel alloy containing nickel (Ni) as a main component, such as Inconel 601 (registered trademark). It is noted that, the present specification, the term "main component" refers to a component having the highest content (% by weight) among all of components of a material. An outer peripheral side of the center electrode 100 is electrically insulated from the outside by the insulator 200. A front end part of the center electrode 100 protrudes to a front end side of the insulator 200, whereas a rear end part of the center electrode 100 makes electrical connection to a rear end side of the insulator 200. In the first embodiment, the rear end part of the center electrode 100 is electrically connected to the rear end side of the insulator 200 through a metal terminal 190.

The insulator 200 of the spark plug 10 is an insulating member with electrical insulation properties. The insulator 200 has a cylindrical shape along the axis CA. In the first embodiment, the insulator 200 is formed by firing an insulating ceramic material (such as alumina). An axial hole 290 is made as a through hole in the insulator 200 so as to extend along the axis CA. The center electrode 100 is retained along the axis CA in the axial hole 290 of the insulator 200, with the front end part of the center electrode 100 protruding from a front end of the insulator 200.

The metal shell 300 of the spark plug 10 is a metallic member with electrical conduction properties. The metal shell 300 also has a cylindrical shape along the axis CA. In the first embodiment, the metal shell 300 is formed of a low carbon steel with a nickel plating. Alternatively, the metal shell 300 may be formed with a zinc plating or may not be given plating (i.e. be formed with no plating). The metal shell 300 is fixed to an outer peripheral side of the insulator 200 by crimping while being electrically insulated from the center electrode 10. An end face 310 is formed on a front end of the metal shell 300. Both of the center electrode 100 and the insulator 200 protrudes from the center of the end face 310 in the +Z axis direction. The ground electrode 400 is joined to the end face 310.

The ground electrode 400 of the spark plug 10 is a second electrode with electrical conduction properties. The ground electrode 400 includes an electrode base 410 and an electrode tip 450. The electrode base 410 has a shape extending from the end face 310 of the metal shell 300 in the +Z axis direction and then bent toward the axis CA. The electrode base 410 is joined at a base end portion thereof to the metal shell 300. The electrode tip 450 is joined to a distal end portion of the electrode base 410 such that the gap SG is defined between the electrode tip 450 and the center electrode 100.

In the first embodiment, the electrode base 410 is formed of a nickel alloy containing nickel (Ni) as a main component as in the case of the center electrode 100. On the other hand, the electrode tip 450 is formed of an alloy containing platinum (Pt) as a main component and 10 mass % of nickel (Ni). It suffices that the material of the electrode tip 450 has higher durability than that of the electrode base 410. The electrode tip 450 may alternatively be formed of a pure noble metal (such as platinum (Pt), iridium (Ir), ruthenium (Ru) or rhodium (Rh)) or any other alloy containing such a noble metal as a main component.

Figure 2A:
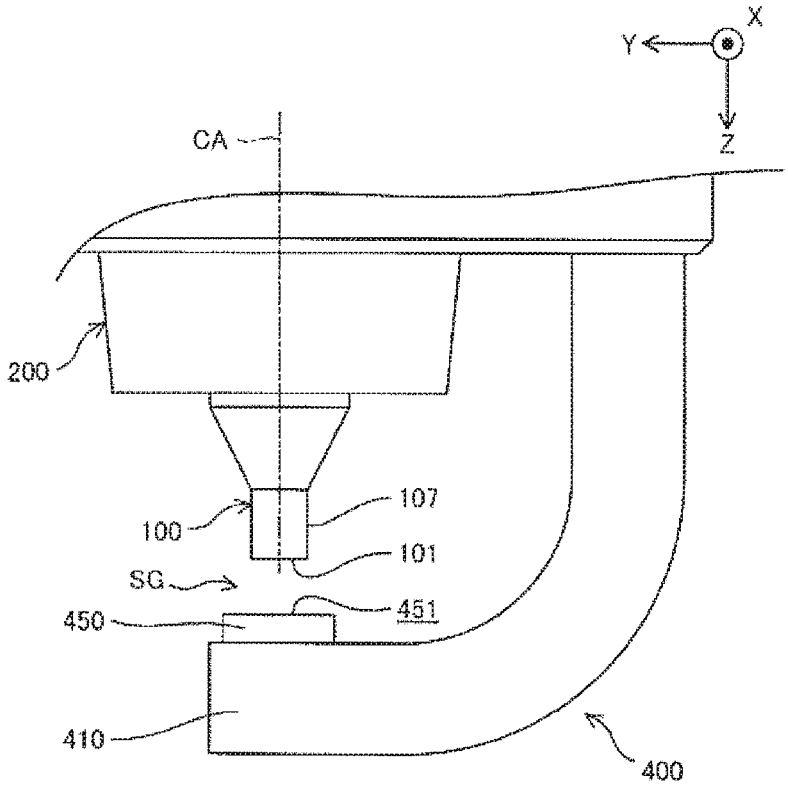
FIG. 2 is a schematic view of a front end part of the spark plug according to the first embodiment of the present invention.
Figure 2B:
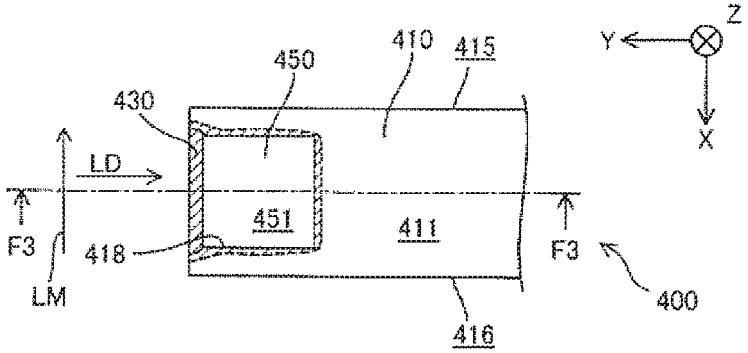
Figure 3:
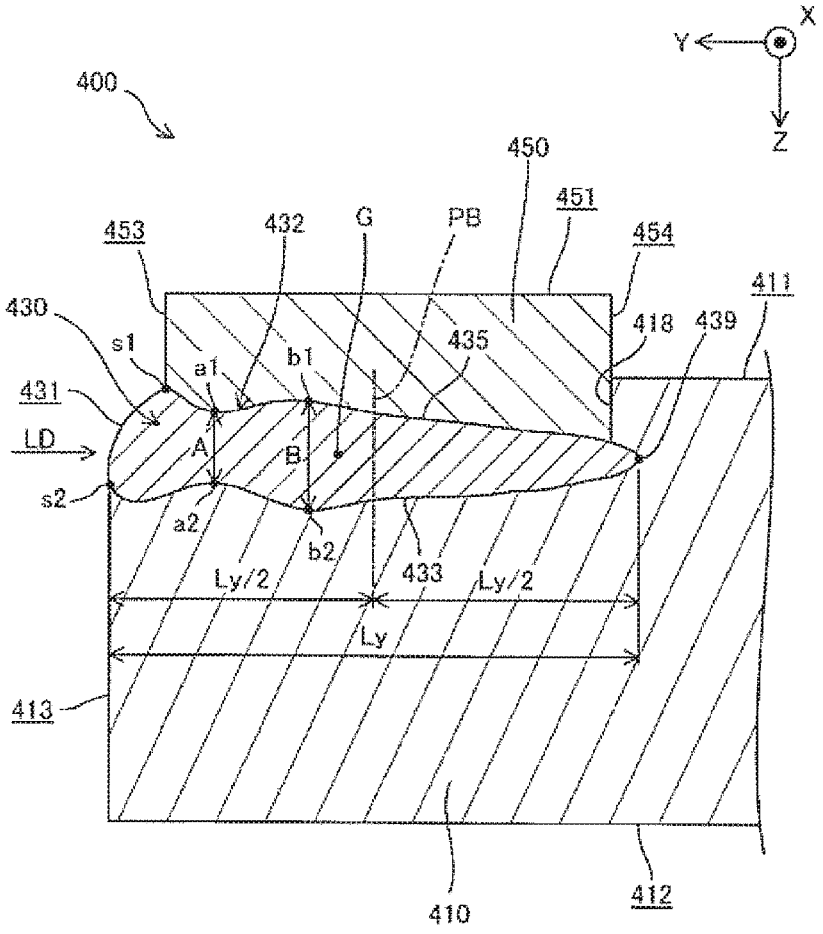
FIG. 3 is cross-sectional view of a distal end part of a ground electrode of the spark plug according to the first embodiment of the present invention.

FIGS. 2(A) and 2(B) are schematic views of a front end part of the spark plug 10. More specifically, FIG. 2(A) shows an enlarged view of the center electrode 100 and the ground electrode 400 as viewed from the +X axis direction; and FIG. 2(B) shows an enlarged view of a distal end part of the ground electrode 400 as viewed from the −Z axis direction. FIG. 3 is a cross-sectional view of the distal end part of the ground electrode 400 as viewed in the direction of arrows F3-F3 of FIG. 2(B).

The center electrode 100 is cylindrical column-shaped including a front end face 101 and a peripheral surface 107 as shown in FIG. 2(A). The front end face 101 and the peripheral surface 107 constitute a front end portion of the center electrode 100. The front end face 101 of the center electrode 100 is a surface extending in parallel to the X and Y axes and facing the +Z axis direction. The peripheral surface 107 of the center electrode 100 is a surface extending in parallel to the Z axis along the circumference of the axis CA. In the first embodiment, the gap SG is defined between the front end face 101 of the center electrode 100 and the electrode tip 450 of the ground electrode 400.

As shown in FIGS. 2 and 3, the electrode body 410 of the ground electrode 400 includes base surfaces 411, 412, 413, 415 and 416. The base surface 411 is a surface formed from the base end portion to the distal end portion of the electrode base 410 and facing the −Z axis direction at the distal end part of the ground electrode 400. The base surface 412 is a surface formed from the base end portion to the distal end portion of the electrode base 410 and facing the +Z axis direction at the distal end part of the ground electrode 400. The base surface 413 is a surface formed on the distal end part of the ground electrode 400 and facing +Y axis direction. The base surface 415 is a surface formed from the base end portion to the distal end portion of the electrode base 410 and facing the −X axis direction. The base surface 416 is a surface formed from the base end portion to the distal end portion of the electrode base 410 and facing the +X axis direction. In the first embodiment, the electrode tip 450 is arranged on a distal end region of the base surface 411 of the electrode base 410.

The electrode tip 450 of the ground electrode 400 is in the form of a rectangular parallelepiped protrusion protruding in the −Z axis direction from the base surface 411 of the electrode base 410 in the first embodiment. As shown in FIGS. 2 and 3, the electrode tip 450 includes tip surfaces 451, 453 and 454. The tip surface 451 is a flat surface located apart from the electrode base 410 and, more specifically, a surface extending in parallel to the X and Y axes and facing the −Z axis direction. The tip surface 453 is a surface extending in parallel to the X and Z axes and facing the +Y axis direction. The tip surface 454 is a surface extending in parallel to the X and Z axes and facing the −Y axis direction. In the first embodiment, the electrode tip 450 is joined to the electrode base 410 at a side of the electrode tip 450 opposite to the tip surface 450 (i.e. at the +Y axis direction side).

The electrode tip 450 is joined to the electrode tip 450 through the following series of steps 1 to 3.

(Step 1) A recess 418 is formed in the electrode base 410.

(Step 2) The electrode tip 450 is placed in the recess 418 of the electrode base 410.

(Step 3) Laser welding is performed on a boundary between the electrode base 410 and the electrode tip 450.

During the laser welding of the electrode tip 450 to the electrode base 410, the emission direction LD of laser beam is set to a plane direction from a +Y axis direction end to −Y axis direction end of the tip surface 451, that is, −Y axis direction in the first embodiment. Alternatively, the emission direction LD may be tilted toward at least one of +X axis direction, −X axis direction, +Z axis direction and −Z axis direction.

Further, the shift direction LM of laser beam is set to a plane direction from a +X axis direction end to −X axis direction end of the tip surface 451, that is, −X axis direction during the laser welding of the electrode tip 450 to the electrode base 410 in the first embodiment. Alternatively, the shift direction LM may be set to +X axis direction. Although the laser beam is shifted in one direction in the first embodiment, it is alternatively feasible shift the laser beam in a reciprocating manner.

When the electrode tip 450 is laser-welded to the electrode base 410, a fused part 430 is formed at the side of the electrode tip 450 opposite to the tip surface 451 (i.e. at the +Y axis direction side of the electrode tip 450). The fused part 430 is a part (so called "weld bead") formed by, after metals of the electrode base 410 and the electrode tip 450 are once molten during the laser welding, solidification of these molten metals.

The fused part 430 includes an exposed surface 431, a boundary surface 433, a boundary surface 435 and an end region 439. The exposed surface 431 of the fused part 430 is a surface formed on the area of emission of the laser beam during the laser welding and exposed from the electrode base 410 and the electrode tip 450. This exposed surface 431 extends from a point s1 of contact with the tip surface 453 to a point s2 of contact with the base surface 413. The boundary surface 433 of the fused part 430 is a surface formed from the contact point s2 to the end region 439 so as to define a boundary between the electrode base 410 and the fused part. The boundary surface 435 of the fused part 430 is a surface formed from the contact point s1 to the end region 439 so as to define a boundary between the electrode tip 450 and the fused part. The end region 439 of the fused part 430 is a region of the fused part 430 located furthest apart from the exposed surface 431.

In FIG. 3, the ground electrode 400 is viewed in cross section along a plane perpendicular to the tip surface 451 and parallel to the emission direction LD (i.e. along a plane parallel to the Y-Z plane). The cross-sectional shape of the fused part 430 has a constricted section 432 at a position from the exposed surface 431 to the end region 439 (i.e. at some point in the −Y axis direction) as shown in FIG. 3. The constricted section 432 of the fused part 430 is a region at which a width of the fused part 430 in the Z axis direction is made smaller at some point in the Y axis direction. The number of constricted sections 432 formed in the fused part 430 is not limited to one. Two or more constricted sections 432 may be formed in the fused part 430.

In the cross-sectional shape of the fused part 430, the width A refers to a minimum width of the fused part 430 in the Z axis direction as measured at the constricted section 432. In the first embodiment, the fused part 430 has the width A at a point a1 on the boundary surface 435 and a point a2 on the boundary surface 433. Further, the width B refers to a maximum width of the fused part 430 as measured at a point further apart from the exposed surface 431 than the points a1 and a2 at which the fused part 430 has the width A (i.e. at a point in the −Y axis direction relative to the points a1 and a2). In the first embodiment, the fused part 430 has the width B at a point b1 on the boundary surface 435 and a point b2 on the boundary surface 433.

For the purpose of suppressing the development of an oxide scale caused due to concentration of stress on the constricted section 432, it is preferable that the width A and the width B satisfy a relationship of $A/B \geq 0.5$. In the first embodiment, the width A and the width B have a relationship of $A/B \geq 0.5$. The width A and the width B may alternatively have a relationship of $A/B < 0.5$.

It is also preferable that, for the purpose of suppressing the development of a crack and oxide scale from the exposed surface 431, at least one point of the constricted section 432 at which the fused part has the minimum width is located closer to the exposed surface 431 than an imaginary line PB which divides a length Ly of the cross-sectional shape of the fused part 430 in the Y axis direction into two equal halves. In the first embodiment, the points a1 and a2 of the constricted section 432 is located closer to the exposed surface 431 than the imaginary line PB. Alternatively, the points a1 and a2 of the constricted section 432 may be located closer to the end region 430 than the imaginary line PB.

It is further preferable that the fused part 430 is formed avoiding the tip surface 451, which is an opposing surface facing the center electrode 100 with the gap SG defined therebetween, for the purpose of preventing a starting point of the crack or oxide scale from being formed in the fused part 430 by the generation of a spark discharge in the gap SG. In the first embodiment, the fused part 430 is formed avoiding the opposing tip surface 451. Alternatively, the fused part 430 may be formed over the opposing surface.

The cross-sectional shape of the fused part 430 taken along the plane parallel to the Y-Z plane, except the constricted section, is tapered in shape in the emission direction LD of the laser beam during the laser welding. Consequently, the center of gravity G (i.e. centroid) of the cross-sectional shape of the fused part 430 taken along the plane parallel to the Y-Z plane is located closer to the exposed surface 431 than the imaginary line PB which divides the length Ly of the cross-sectional shape of the fused part 430 in the Y axis direction into two equal halves FIG. 4 is a table showing the results of durability evaluation test of the spark plug 10. In the durability evaluation test of FIG. 4, a plurality of test samples of the spark plug 10 were prepared by changing the shape of the fused part 430 between the electrode base 410 and the electrode tip 450 of the ground electrode 400.

The common specifications of the electrode base 410 of the respective test samples were as follows.

Material: Inconel 601

Cross-sectional dimension of distal end portion (X-axis direction length): 2.7 mm (millimeters)

Cross-sectional dimension of distal end portion (Z-axis direction length): 1.3 mm (millimeters)

The common specifications of the electrode tip 450 of the respective test samples were as follows.

Material: alloy containing platinum (Pt) as a main component and 10 mass % of nickel (Ni)

Shape: rectangular parallelepiped shape

X-axis direction length: 1.3 mm

Y-axis direction length: 1.3 mm

Thickness before welding: 0.4 mm

In the preparation of the test samples, the shape of the fused part 430 was changed by setting varying combinations of laser output and processing speed as different welding conditions, each condition for 5 samples, during the laser welding of the electrode tip 450 to the electrode base 410. The laser output was in the range of 300 to 420 W (watts). The processing speed was in the range of 50 to 150 mm/sec.

Each test sample was then subjected to 1000 cycles of the following thermal steps 1 and 2.

(Step 1) The electrode tip 450 joined to the electrode base 410 was heated with a burner for 2 minutes such that the temperature of the electrode tip 450 reached 1030° C.

(Step 2) The electrode tip 450 was cooled by air blowing for 1 minute.

After the above thermal cycle process, the ground electrode 400 of each test sample was cut along the Y-Z plane. The cross-sectional shape of the fused part 430 was confirmed. Further, the occurrence or non-occurrence of a crack and oxide scale at boundaries of the fused part 430 was checked. The rate of the oxide scale occupying the whole of the boundaries between the fused part 430 and the electrode base 410 and between the fused part 430 and the electrode tip 450 was determined.

In the five test samples A1 to A5, the cross-sectional shape of the fused part 430 was tapered in the emission direction LD of the laser beam with no constricted section 432. Among the test samples A1 to A5, there occurred a crack at the boundaries of the fused part 430 in the test samples A2, A3 and A5. The rate of the oxide scale was 32 to 69% in the test samples A1 to A5.

The five test samples B1 to B5 were prepared under the welding condition 2 of higher laser output than the welding condition 1 of the test samples A1 to A5. In these test samples B1 to B5, the cross-sectional shape of the fused part 430 was tapered in the emission direction LD of the laser beam with no constricted section 432; and the width of the fused part 430 in the Z axis direction was relatively larger than that in the test samples A1 to A5. Among the test samples B1 to B5, there occurred a crack at the boundaries of the fused part 430 in the test samples B1 and B2. The rate of the oxide scale was 9 to 24% in the test samples B1 to B5.

In the five samples C1 to C5, the cross-sectional shape of the fused part 430 had a constricted section 430 as in FIG. 3. The ratio (A/B)×100 of the constricted section 432 was 69 to 85% in the test samples C1 to C5. There was no crack found at the boundaries of the fused part 430 in any of the test samples C1 to C5. The rate of the oxide scale was 15 to 22% in the test samples C1 to C5.

The five test samples D1 to D5 were prepared under the welding condition 4 of higher laser output than the welding condition 3 of the test samples C1 to C5. In these test samples D1 to D5, the cross-sectional shape of the fused part 430 had a constricted section 430 as in FIG. 3; and the width of the fused part 430 in the Z axis direction was relatively larger than that in the test samples C1 to C5. The ratio (A/B)×100 of the constricted section 432 was 63 to 79% in the test samples D1 to D5. There was no crack found at the boundaries of the fused part 430 in any of the test samples D1 to D5. The rate of the oxide scale was 10 to 17% in the test samples D1 to D5.

The five test samples E1 to E5 were prepared under the welding condition 5 of higher laser output and higher processing speed than the welding condition 3 of the test samples C1 to C5. In these test samples E1 to E5, the cross-sectional shape of the fused part 430 had a constricted section 430 as in FIG. 3. The ratio (A/B)×100 of the constricted section 432 was 48 to 53% in the test samples E1 to E5. There was no crack found at the boundaries of the fused part 430 in any of the test samples E1 to E5. The rate of the oxide scale was 15 to 20% in the test samples E1 to E5.

The five test samples F1 to F5 were prepared under the welding condition 6 of higher laser output and higher processing speed than the welding condition 5 of the test samples E1 to E5. In these test samples F1 to F5, the cross-sectional shape of the fused part 430 had a constricted section 430 as in FIG. 3. The ratio (A/B)×100 of the constricted section 432 was 32 to 42% in the test samples F1 to F5. There was no crack found at the boundaries of the fused part 430 in any of the test samples F1 to F5. The rate of the oxide scale was 38 to 50% in the test samples F1 to F5.

It is apparent from comparison of the evaluation test results of the test samples A1 to A5 and B1 to B5 and the evaluation test results of the test samples C1 to C5, D1 to D5, E1 to E5 and F1 to F5 in FIG. 4 that it is possible to suppress the development of a crack at the boundaries of the fused part 43 by forming the cross-sectional shape of the fused part 430 with the constricted section 432.

It is also apparent from comparison of the evaluation test results of the test samples C1 to C5, D1 to D5 and E1 to E5 and the evaluation test results of the test samples F1 to F5 in FIG. 4 that it is possible to suppress the development of an oxide scale at the boundaries of the fused part 430 by controlling the ratio (A/B)×100 to 50% or greater, i.e., satisfying the relationship of A/B≥0.5. The reason for this is assumed that, when the ratio (A/B)×100 is too small, i.e., the constricted section 432 is too deep, the development of the oxide scale is promoted with increase in the amount of stress concentrated on the constricted section 432.

As described above, the presence of the constricted section 432 in the fused part 430 makes it possible to prevent the occurrence of a crack at the boundaries of the fused part 430. As compared to the case where the cross-sectional shape of the fused part 430 has no constricted section 432, the presence of the constricted section 432 in the fused part 430 leads to longer lengths of the boundaries between the electrode tip 450 and the fused part 430 and between the electrode base 410 and the fused part 430 and thus makes it possible to, even when at least one of a crack and an oxide scale occur at the boundaries, suppress the development of such a crack or oxide scale such that the electrode tip 450 does not become separated and fall off from the electrode base. Accordingly, it is possible to improve the lifetime of the spark plug 10.

Further, it is possible by satisfaction of A/B≥0.5 to effectively suppress the oxide scale from being developed due to the concentration of stress on the constricted section 432.

In the cross-sectional shape of the fuses part 430, at least one point a1, a2 of the constricted section 432 at which the fused part has the minimum length A is located closer to the exposed surface 431 than the imaginary line PB in the first embodiment. It is thus possible to effectively suppress the crack and oxide scale from being developed from the exposed surface 431.

Furthermore, the fused part 430 is formed avoiding the tip surface 451 facing the center electrode 100 in the first embodiment. It is thus possible to prevent a starting point of the crack and oxide scale from being formed in the fused part 430 by the generation of a spark discharge in the gap SG.

B. Second Embodiment

Figure 5:
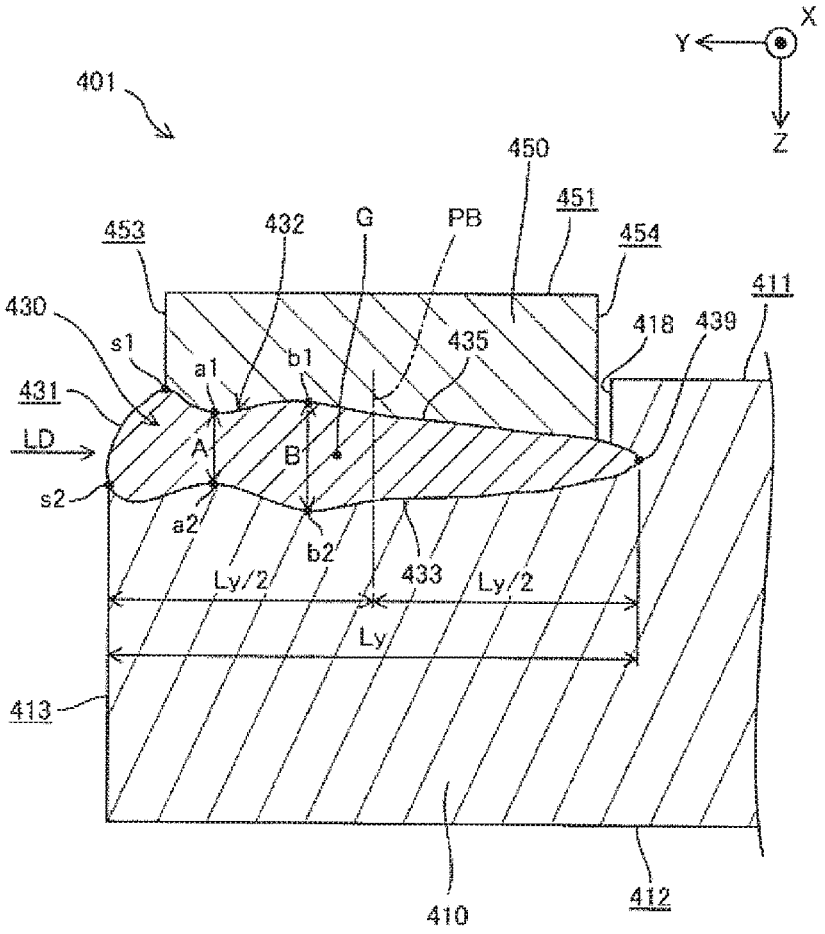
FIG. 5 is a cross-sectional view of a distal end part of a ground electrode of a spark plug according to a second embodiment of the present invention.

FIG. 5 is a cross-sectional view of a distal end part of a ground electrode 401 of a spark plug according to a second embodiment of the present invention. The spark plug 10 of the second embodiment is the same as that of the first embodiment, except that the ground electrode 401 of the second embodiment is different from the ground electrode 400 of the first embodiment. More specifically, the ground electrode 401 of the second embodiment is the same as the ground electrode 400 of the first embodiment, except that the ground electrode 401 has a clearance between the recess 418 of the electrode base and the tip surface 454 of the electrode tip 450. It is possible in the second embodiment to improve the lifetime of the spark plug 10 in the same manner as in the first embodiment.

C. Third Embodiment

Figure 6:
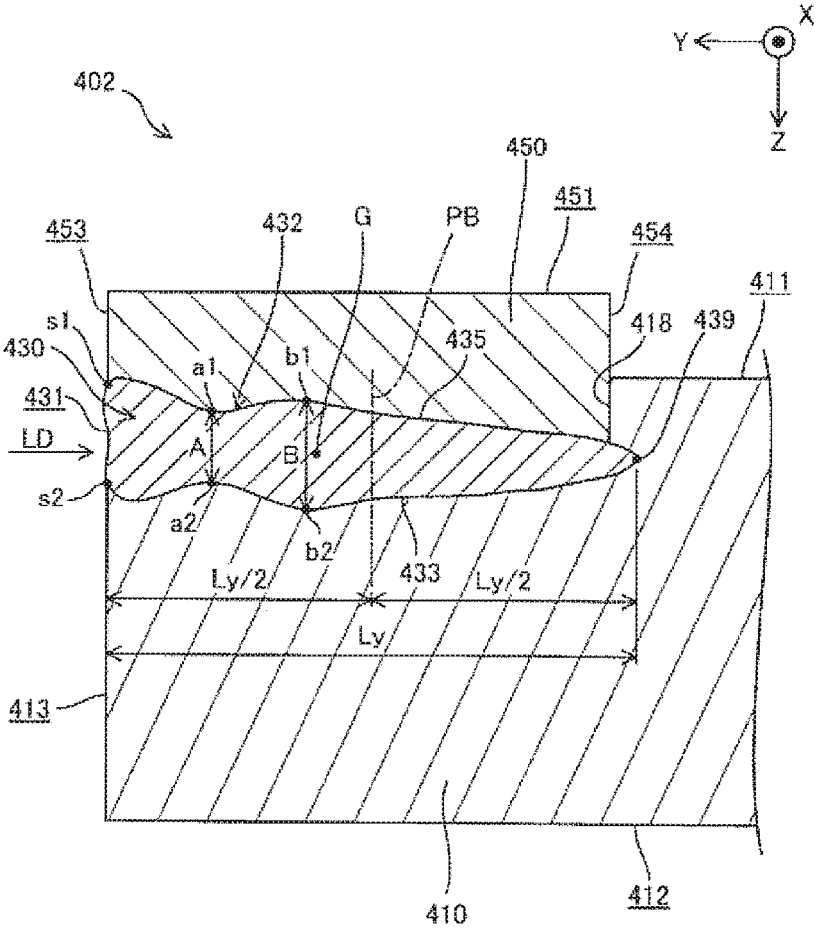
FIG. 6 is a cross-sectional view of a distal end part of a ground electrode of a spark plug according to a third embodiment of the present invention.

FIG. 6 is a cross-sectional view of a distal end part of a ground electrode 402 of a spark plug according to a third embodiment of the present invention. The spark plug 10 of the third embodiment is the same as that of the first embodiment, except that the ground electrode 402 of the third embodiment is different from the ground electrode 400 of the first embodiment. More specifically, the ground electrode 402 of the third embodiment is the same as the ground electrode 400 of the first embodiment, except that the tip surface 453 of the electrode tip 450 is flush with the base surface 413 of the electrode base 410 in the ground electrode 402. It is possible in the third embodiment to improve the lifetime of the spark plug 10 in the same manner as in the first embodiment.

D. Fourth Embodiment

Figure 7:
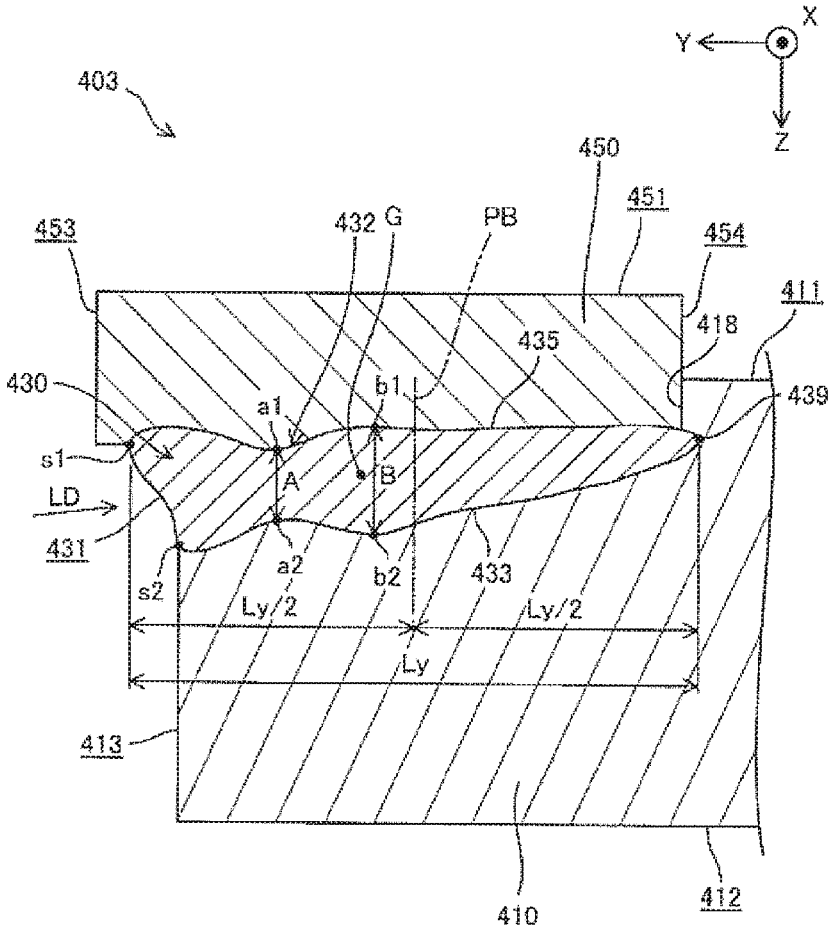
FIG. 7 is a cross-sectional view of a distal end part of a ground electrode of a spark plug according to a fourth embodiment of the present invention.

FIG. 7 is a cross-sectional view of a distal end part of a ground electrode 403 of a spark plug according to a fourth embodiment of the present invention. The spark plug 10 of the fourth embodiment is the same as that of the first embodiment, except that the ground electrode 403 of the fourth embodiment is different from the ground electrode 400 of the first embodiment. More specifically, the ground electrode 403 of the fourth embodiment is the same as the ground electrode 400 of the first embodiment, except that: the tip surface 453 of the electrode tip 450 protrudes in the +Y axis direction from the base surface 413 of the electrode base 410; and the −Y axis direction side of the fused part 430 is tilted toward the −Z axis direction according to the emission direction LD. It is possible in the fourth embodiment to improve the lifetime of the spark plug 10 in the same manner as in the first embodiment.

In the fourth embodiment, the tip surface 451 of the electrode tip 450 faces the center electrode 100 with the gap SG defined between the tip surface 451 and the front end face 101 of the center electrode 100. It is feasible to modify the fourth embodiment such that the tip surface 453 of the electrode tip 450 faces the center electrode 100 with the gap SG defined between the tip surface 453 and the peripheral surface 107 of the center electrode 100.

E. Fifth Embodiment

Figure 8:
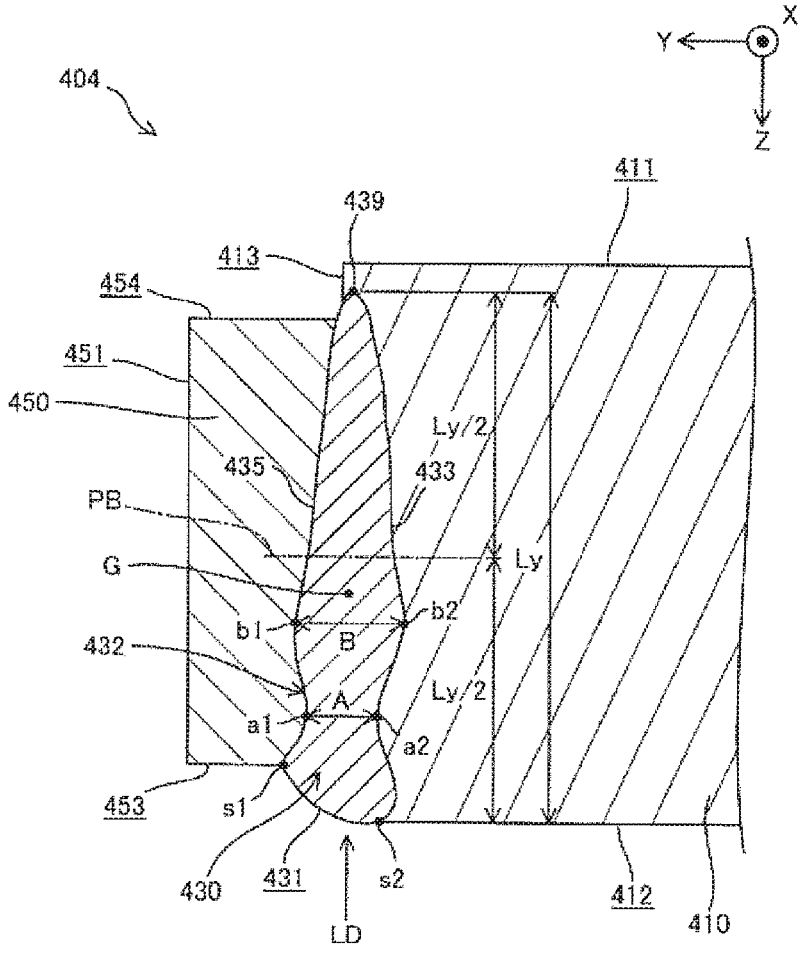
FIG. 8 is a cross-sectional view of a distal end part of a ground electrode of a spark plug according to a fifth embodiment of the present invention.

FIG. 8 is a cross-sectional view of a distal end part of a ground electrode 404 of a spark plug according to a fifth embodiment of the present invention. The spark plug 10 of the fifth embodiment is the same as that of the first embodiment, except that the ground electrode 404 of the fifth embodiment is different from the ground electrode 400 of the first embodiment. More specifically, the ground electrode 404 of the fifth embodiment is the same as the ground electrode 400 of the first embodiment, except that: the electrode tip is joined to the base surface 413, rather than to the base surface 411, with the tip surface 451 facing the +Y axis direction; and the gap SG is defined between the tip surface 451 and the peripheral surface 107 of the center electrode 100. It is possible in the fifth embodiment to improve the lifetime of the spark plug 10 in the same manner as in the first embodiment.

F. Sixth Embodiment

Figures 9, 10:
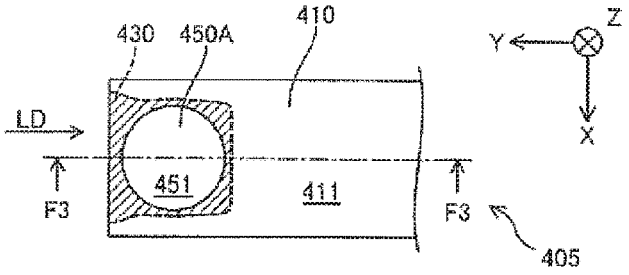
FIG. 9 is a schematic view of a distal end part of a ground electrode of a spark plug according to a sixth embodiment of the present invention.
FIG. 10 is a table showing the results of durability evaluation test of the spark plug.

FIG. 9 is a schematic view of a distal end part of a ground electrode 405 of a spark plug according to a sixth embodiment of the present invention. The spark plug 10 of the sixth embodiment is the same as that of the first embodiment, except that the ground electrode 405 of the sixth embodiment is different from the ground electrode 400 of the first embodiment. More specifically, the ground electrode 405 of the sixth embodiment is the same as the ground electrode 400 of the first embodiment, except that the ground electrode 450 has a different electrode tip 450A from the electrode tip 450 of the first embodiment. The electrode tip 450A of the sixth embodiment is the same as the electrode tip 450 of the first embodiment, except that the electrode tip 450 is in the form of a cylindrical column-shaped protrusion protruding in the −Z axis direction from the base surface 411 of the electrode base 410. The cross-sectional shape of the ground electrode 405 as viewed in the direction of arrows F3-F3 of FIG. 9 is similar to that of the ground electrode 400 shown in FIG. 6.

FIG. 10 is a table showing the results of durability evaluation test of the spark plug 10. In the durability evaluation test of FIG. 10, a plurality of test samples of the spark plug 10 were prepared by changing the shape of the fused part 430 between the electrode base 410 and the electrode tip 450 of the ground electrode 405 in the same manner as in the durability evaluation test of FIG. 4.

The common specifications of the electrode base 410 of the respective test samples were as follows.

Material: Inconel 601

Cross-sectional dimension of distal end portion (X-axis direction length): 2.8 mm (millimeters)

Cross-sectional dimension of distal end portion (Z-axis direction length): 1.5 mm (millimeters)

The common specifications of the electrode tip 450A of the respective test samples were as follows.

Material: alloy containing platinum (Pt) as a main component and 10 mass % of iridium (Ir)

Shape: cylindrical column shape

Diameter: 1.5 mm

Thickness before welding: 0.4 mm

In the preparation of the test samples, the shape of the fused part 430 was changed by setting varying combinations of laser output and processing speed as different welding conditions, each condition for 3 samples, during the laser welding of the electrode tip 450A to the electrode base 410. The laser output was in the range of 320 to 450 W. The processing speed was in the range of 50 to 150 mm/sec.

Each test sample was then subjected to the same thermal cycles as in the durability evaluation test of FIG. 4. After that, the ground electrode 405 of each test sample was cut along the Y-Z plane. The cross-sectional shape of the fused part 430 was confirmed. Further, the occurrence or non-occurrence of a crack and oxide scale at boundaries of the fused part 430 was checked.

In the three test samples G1 to G3, the cross-sectional shape of the fused part 430 was tapered in the emission direction LD of the laser beam with no constricted section 432. There occurred a crack at the boundaries of the fused part 430 in each of the test samples G1 to G3. The rate of the oxide scale was 53 to 70% in the test samples A1 to A5.

The three test samples H1 to H3 were prepared under the welding condition 8 of higher laser output than the welding condition 7 of the test samples G1 to G3. In these test samples H1 to H3, the cross-sectional shape of the fused part 430 was tapered in the emission direction LD of the laser beam with no constricted section 432; and the width of the fused part 430 in the Z axis direction was relatively larger than that in the test samples G1 to G3. Among the test samples H1 to H3, there occurred a crack at the boundaries of the fused part 430 in the test sample H3. The rate of the oxide scale was 44 to 50% in the test samples H1 to H3.

In the three samples I1 to I3, the cross-sectional shape of the fused part 430 had a constricted section 430 as in FIG. 3. The ratio (A/B)×100 of the constricted section 432 was 69 to 77% in the test samples I1 to I3. There was no crack found at the boundaries of the fused part 430 in any of the test samples H1 to H3. The rate of the oxide scale was 19 to 25% in the test samples I1 to I3.

The three test samples J1 to J3 were prepared under the welding condition 10 of higher laser output than the welding condition 9 of the test samples I1 to I3. In these test samples J1 to J3, the cross-sectional shape of the fused part 430 had a constricted section 430 as in FIG. 3; and the width of the fused part 430 in the Z axis direction was relatively larger than that in the test samples I1 to I3. The ratio (A/B)×100 of the constricted section 432 was 63 to 67% in the test samples J1 to J3. There was no crack found at the boundaries of the fused part 430 in any of the test samples J1 to J3. The rate of the oxide scale was 11 to 16% in the test samples J1 to J3.

The three test samples K1 to K3 were prepared under the welding condition 11 of higher laser output and higher processing speed than the welding condition 9 of the test samples I1 to I3. In these test samples K1 to K3, the cross-sectional shape of the fused part 430 had a constricted section 430 as in FIG. 3. The ratio (A/B)×100 of the constricted section 432 was 50 to 55% in the test samples K1 to K3. There was no crack found at the boundaries of the fused part 430 in any of the test samples K1 to K3. The rate of the oxide scale was 17 to 20% in the test samples K1 to K3.

The three test samples L1 to L3 were prepared under the welding condition 12 of higher laser output and higher processing speed than the welding condition 11 of the test samples K1 to K3. In these test samples L1 to L3, the cross-sectional shape of the fused part 430 had a constricted section 430 as in FIG. 3. The ratio (A/B)×100 of the constricted section 432 was 35 to 44% in the test samples L1 to L3. There was no crack found at the boundaries of the fused part 430 in any of the test samples L1 to L3. The rate of the oxide scale was 31 to 42% in the test samples L1 to L3.

It is apparent from comparison of the evaluation test results of the test samples G1 to G3 and H1 to H3 and the evaluation test results of the test samples I1 to I3, J1 to J3, K1 to K3 and L1 to L3 in FIG. 10 that it is possible to suppress the development of a crack at the boundaries of the fused part 43 by forming the cross-sectional shape of the fused part 430 with the constricted section 432. It is also apparent from comparison of the evaluation test results of the test samples I1 to I3, J1 to J3 and K1 to K3 and the evaluation test results of the test samples L1 to L3 in FIG. 10 that it is possible to suppress the development of an oxide scale at the boundaries of the fused part 430 by controlling the ratio (A/B)×100 to 50% or greater, i.e., satisfying the relationship of A/B≥0.5.

It is possible in the sixth embodiment to improve the lifetime of the spark plug 10 in the same manner as in the first embodiment. As modifications of the sixth embodiment, any of the configurations of the second to fifth embodiments may be applied to the ground electrode 405 of the sixth embodiment.

G. Seventh Embodiment

Figure 11:
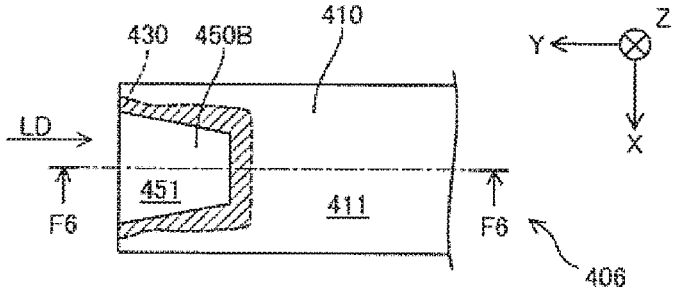
FIG. 11 is a schematic view of a distal end part of a ground electrode of a spark plug according to a seventh embodiment of the present invention.

FIG. 11 is a schematic view of a distal end part of a ground electrode 406 of a spark plug according to a seventh embodiment of the present invention. The spark plug 10 of the seventh embodiment is the same as that of the third embodiment, except that the ground electrode 406 of the seventh embodiment is different from the ground electrode 402 of the third embodiment. More specifically, the ground electrode 406 of the seventh embodiment is the same as the ground electrode 402 of the third embodiment, except that the ground electrode 406 has a different electrode tip 450B from the electrode tip 450 of the third embodiment. The electrode tip 450B of the seventh embodiment is the same as the electrode tip 450 of the third embodiment, except that the electrode tip 450A is in the form of a trapezoidal column-shaped protrusion protruding in the −Z axis direction from the base surface 411 of the electrode base 410. The cross-sectional shape of the ground electrode 406 as viewed in the direction of arrows F6-F6 of FIG. 11 is similar to that of the ground electrode 402 shown in FIG. 6. It is possible in the seventh embodiment to improve the lifetime of the spark plug 10 in the same manner as in the first embodiment. As modifications of the seventh embodiment, any of the configurations of the first, second, fourth and fifth embodiments may be applied to the ground electrode 406 of the seventh embodiment.

H. Eighth Embodiment

Figure 12:
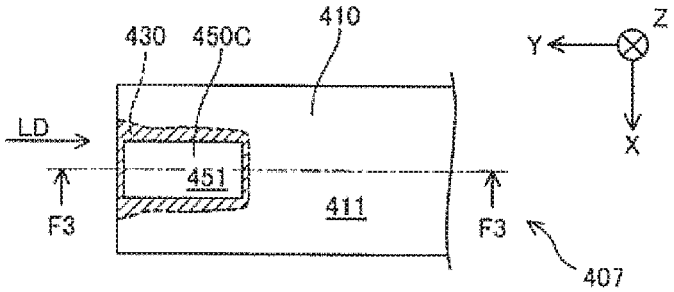
FIG. 12 is a schematic view of a distal end part of a ground electrode of a spark plug according to an eighth embodiment of the present invention.

FIG. 12 is a schematic view of a distal end part of a ground electrode 407 of a spark plug according to an eighth embodiment of the present invention. The spark plug 10 of the eighth embodiment is the same as that of the first embodiment, except that the ground electrode 407 of the eighth embodiment is different from the ground electrode 400 of the first embodiment. More specifically, the ground electrode 407 of the eighth embodiment is the same as the ground electrode 400 of the first embodiment, except that the ground electrode 407 has a different electrode tip 450C from the electrode tip 450 of the first embodiment. The electrode tip 450C of the eighth embodiment is the same as the electrode tip 450 of the first embodiment, except that a width of the electrode tip 450C in the X axis direction is smaller than a width of the electrode tip 450C in the Y axis direction. The cross-sectional shape of the ground electrode 407 as viewed in the direction of arrows F3-F3 of FIG. 12 is similar to that of the ground electrode 400 shown in FIG. 3. It is possible in the eighth embodiment to improve the lifetime of the spark plug 10 in the same manner as in the first embodiment. As modifications of the eighth embodiment, any of the configurations of the second to fifth embodiments may be applied to the ground electrode 407 of the eighth embodiment.

I. Ninth Embodiment

Figure 13:
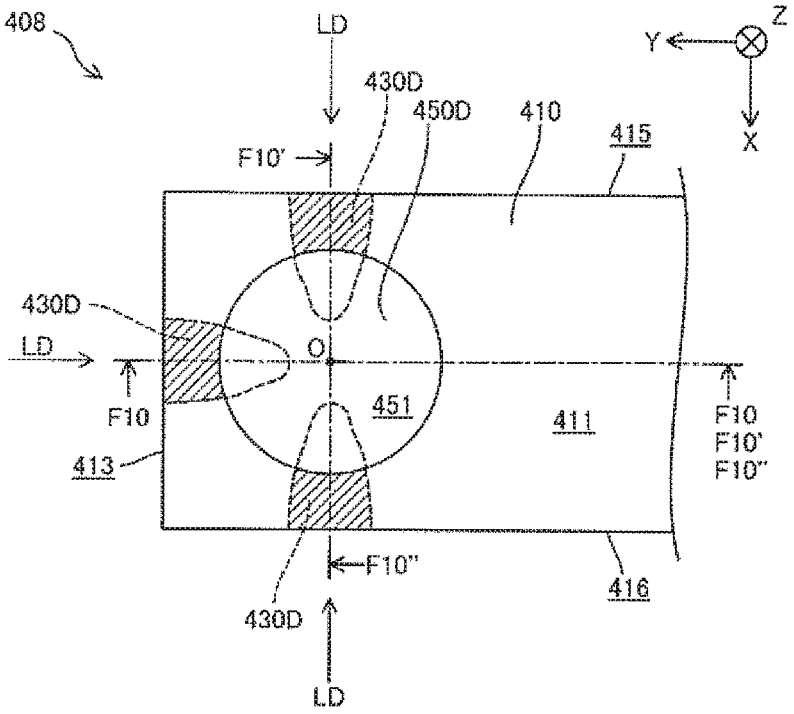
FIG. 13 is a schematic view of a distal end part of a ground electrode of a spark plug according to a ninth embodiment of the present invention.
Figure 14:
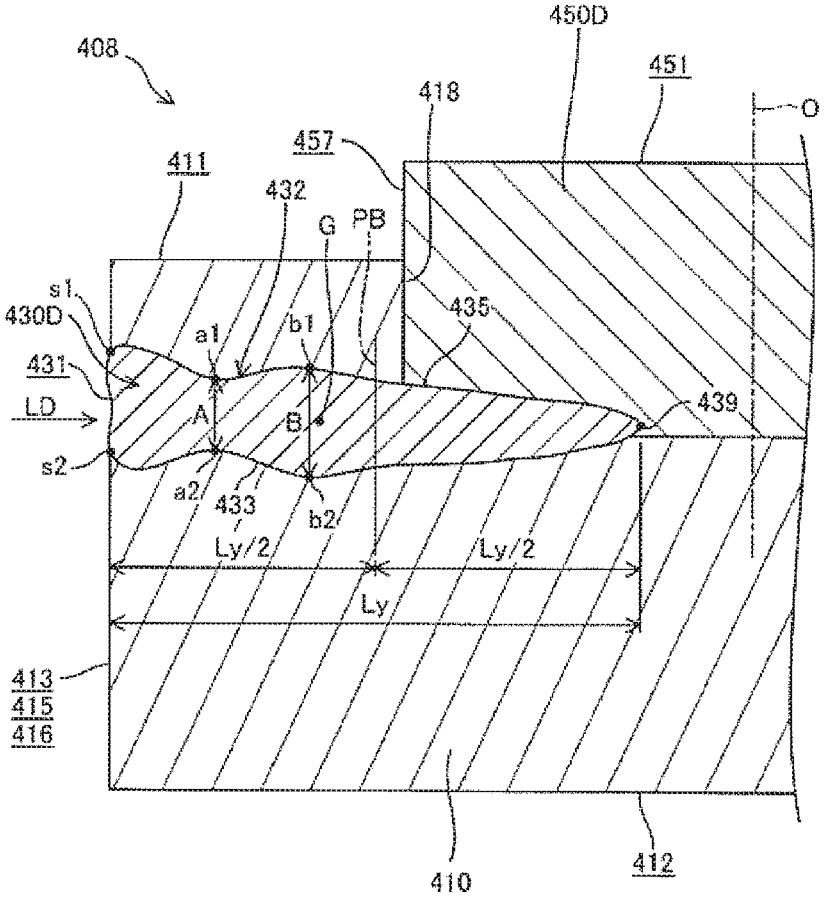
FIG. 14 is a cross-sectional view of the distal end part of the ground electrode of the spark plug according to the ninth embodiment of the present invention.

FIG. 13 is a schematic view of a distal end part of a ground electrode 408 of a spark plug according to a ninth embodiment of the present invention. FIG. 14 is a cross-sectional view of the distal end part of the ground electrode 408 of the spark plug according to the ninth embodiment of the present invention. In FIG. 14, the ground electrode 408 is viewed in cross section in the direction of arrows F10-O-F10, F10'-O-F10' or F10"-O-F10" of FIG. 13.

The spark plug 10 of the ninth embodiment is the same as that of the sixth embodiment, except that the ground electrode 408 of the ninth embodiment is different from the ground electrode 405 of the sixth embodiment. More specifically, the ground electrode 408 of the ninth embodiment is the same as the ground electrode 405 of the sixth embodiment, except that the ground electrode 408 has fused parts 430D different in shape and position from the fused part 430 of the sixth embodiment. In the ninth embodiment, the ground electrode 408 has an electrode tip 450D in the form of a cylindrical column-shaped protrusion protruding in the −Z axis direction from the base surface 411 of the electrode base 410 as in the case of the electrode tip 450A of the sixth embodiment. Herein, an axis of the electrode tip 450D is indicated by an imaginary line O.

During the laser welding of the electrode tip 450D to the electrode base 410 of the ground electrode 408, the emission direction LD of laser beam is set to −Y axis direction from the base surface 413 toward the electrode tip 450D, −Y axis direction from the base surface 415 toward the electrode tip 450D and +X axis direction from the base surface 416 toward the electrode tip 450D in the ninth embodiment. As a consequence, three fused parts 430D are formed in the ground electrode 408. The cross-sectional shape of each of these three fused parts 430D has a constricted section 432 as in the case of the fused part 430 of the first embodiment.

It is possible in the ninth embodiment to improve the lifetime of the spark plug 10 in the same manner as in the first embodiment. As modifications of the ninth embodiment, the fused part 430D of the ninth embodiment may be applied to any of the configurations of the first to eighth embodiments.

J. Tenth Embodiment

Figure 15:
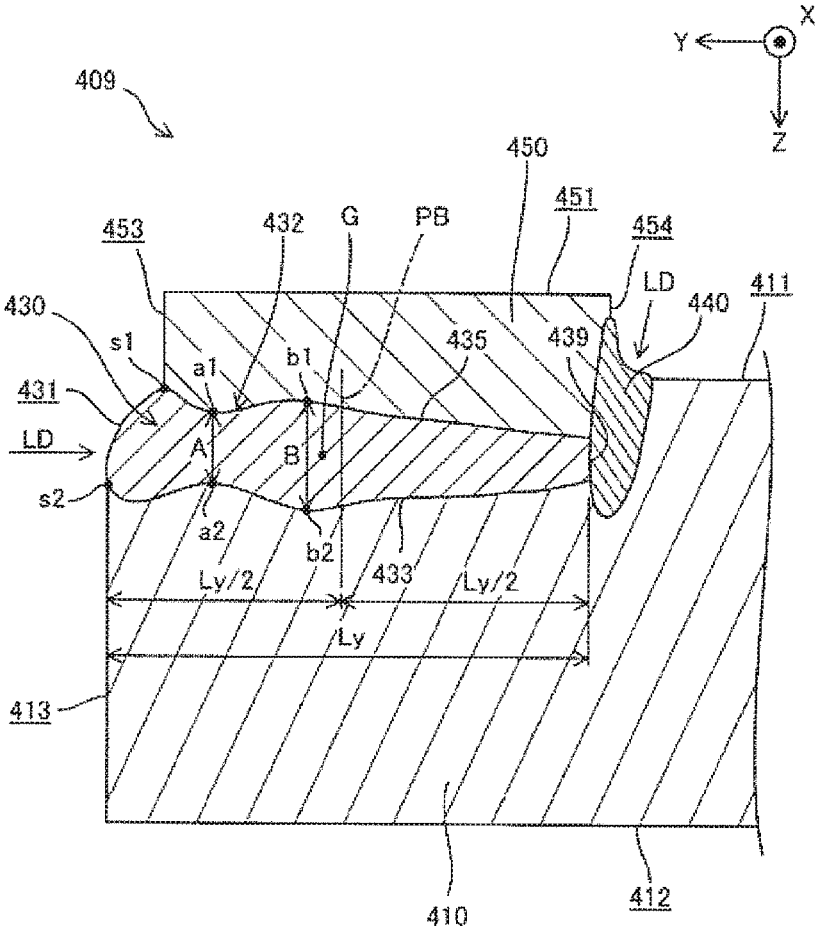
FIG. 15 is a schematic view of a distal end part of a ground electrode of a spark plug according to a tenth embodiment of the present invention.

FIG. 15 is a schematic view of a distal end part of a ground electrode 409 of a spark plug according to a tenth embodiment of the present invention. The spark plug 10 of the tenth embodiment is the same as that of the first embodiment, except that the ground electrode 409 of the tenth embodiment is different from the ground electrode 400 of the first embodiment. More specifically, the ground electrode 409 of the tenth embodiment is the same as the ground electrode of the first embodiment, except that the ground electrode 409 has another fused part 440 in addition to the fused part 430 to join the electrode tip 450. The fused part 440 of the ground electrode 409 is a weld bead formed by the laser welding of the tip surface 454 of the electrode tip 450 to the electrode base 410 after the formation of the fused part 430. In the tenth embodiment, the −Y axis direction side of the fused part 430 is included in the fused part 440; and the end region 439 of the fused part 430 is located adjacent to the fused part 440. It is possible in the tenth embodiment to improve the lifetime of the spark plug 10 in the same manner as in the first embodiment. As modifications of the tenth embodiment, the fused part 440 of the tenth embodiment may be applied to any of the configurations of the first to ninth embodiments.

K. Eleventh Embodiment

Figure 16:
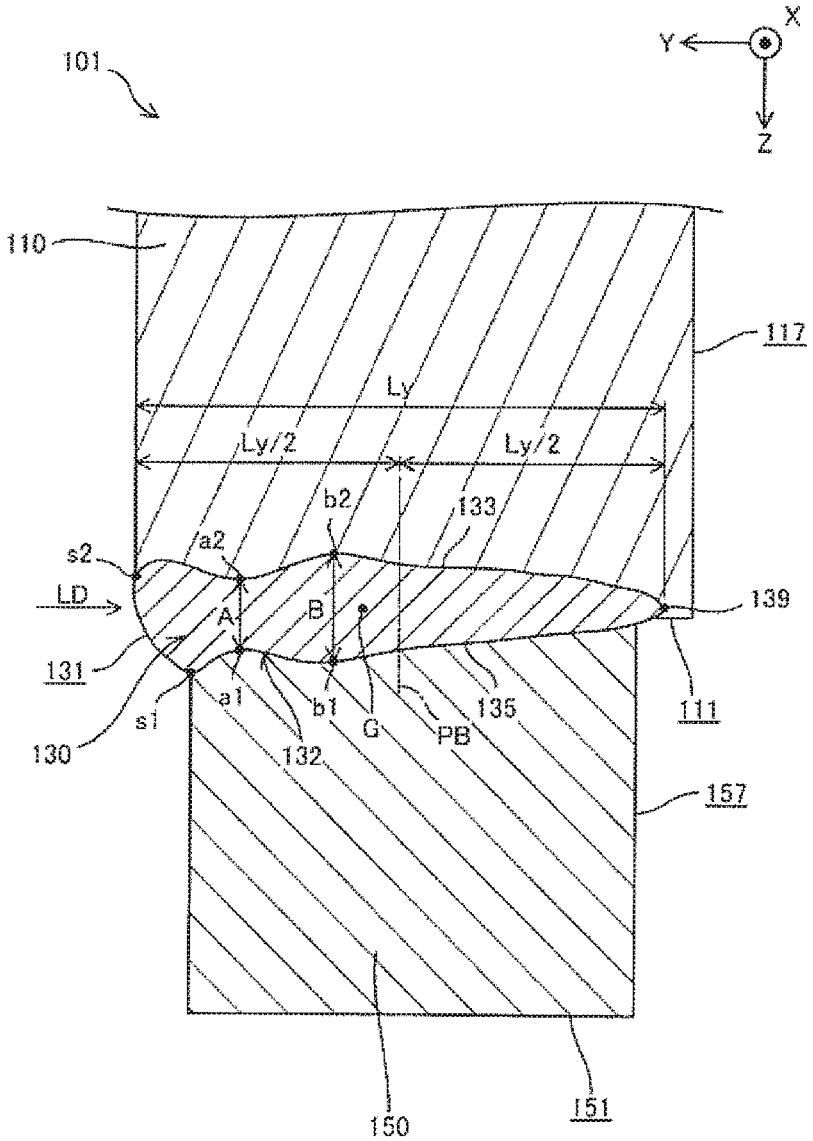
FIG. 16 is a cross-sectional view of a front end part of a center electrode of a spark plug according to an eleventh embodiment of the present invention.

FIG. 16 is a cross-sectional view of a distal end part of a center electrode of a spark plug according to an eleventh embodiment of the present invention. The spark plug 10 of the eleventh embodiment is the same as that of the first embodiment, except that the center electrode 100 includes an electrode base 110 and an electrode tip 150 joined to the electrode base 110 in the eleventh embodiment.

The electrode base 110 of the center electrode 100 has a cylindrical column shape along the axis CA and includes an end face 111 and a peripheral surface 117. In the eleventh embodiment, the electrode base 110 is formed of a nickel alloy containing nickel (Ni) as a main component.

The electrode tip 150 of the center electrode 150 has a cylindrical column shape along the axis CA and includes an end surface 151 and a peripheral surface 157. The electrode tip 150 is joined to the end face 111 of the electrode base 110. In the eleventh embodiment, the electrode tip 150 is formed of the same material as that of the electrode tip 450 of the ground electrode 400. The end surface 151 of the electrode tip 150 is a surface located apart from the electrode base 110 and provided as an opposing surface facing the ground electrode 400 with the gap SG defined therebetween.

As in the case of the fused part 430 of the ground electrode 400, a fused part 130 is formed by laser welding between the electrode tip 150 and the electrode base 110. The fused part 130 is a part (so called "weld bead") formed by, after metals of the electrode base 110 and the electrode tip 150 are once molten during the laser welding, solidification of these molten metals.

The fused part 130 includes an exposed surface 131, a boundary surface 133, a boundary surface 135 and an end region 139. The exposed surface 131 of the fused part 130 is a surface formed on the area of emission of the laser beam during the laser welding and exposed from the electrode base 110 and the electrode tip 150. This exposed surface 431 extends from a point s1 of contact with the peripheral surface 157 of the electrode tip 150 to a point s2 of contact with the peripheral surface 117 of the electrode base 110. The boundary surface 133 of the fused part 130 is a surface formed from the contact point s2 to the end region 139 so as to define a boundary between the electrode base 110 and the fused part. The boundary surface 135 of the fused part 130 is a surface formed from the contact point s1 to the end region 139 so as to define a boundary between the electrode tip 150 and the fused part. The end region 139 of the fused part 130 is a region of the fused part 130 located furthest apart from the exposed surface 131.

As shown in FIG. 16, the cross-sectional shape of the fused part 130 has a constricted section 132 at a position from the exposed surface 131 to the end region 139 (i.e. at some point in the −Y axis direction). The constricted section 132 of the fused part 130 is a region at which a width of the fused part 130 in the Z axis direction once decreases and then increases in the −Y axis direction. The number of constricted sections 132 formed in the fused part 130 is not limited to one. Two or more constricted sections 132 may be formed in the fused part 130. The features of the cross-sectional shape of the fused part 130 of the center electrode 100 are similar to those of the cross-sectional shape of the fused part 430 of the ground electrode 400.

In the eleventh embodiment, the presence of the constricted section 132 in the fused part 130 makes it possible to prevent the occurrence of a crack at the boundaries of the fused part 130 and makes it possible to, even when at least one of a crack and an oxide scale occur at the boundaries, suppress the development of such a crack or oxide scale such that the electrode tip 150 does not become separated and fall off from the electrode base, as in the case of the fused part 430 of the ground electrode 400. By these effects, it is possible to improve the lifetime of the spark plug 10. As modifications of the eleventh embodiment, the center electrode 100 of the eleventh embodiment may be applied to any of the configurations of the first to tenth embodiments or may be applied to a ground electrode in which a ground electrode has an electrode tip joined to an electrode base via a fused part with no constricted section 432 or a spark plug in which a ground electrode has no electrode tip.

L. Other Embodiments

The present invention is not limited to the above specific embodiments, examples and modifications and can be embodied in various forms without departing from the scope of the present invention. For example, it is possible to appropriately replace or combine any of the technical features mentioned above in "Summary of the Invention" and "Description of the Embodiments" in order to solve part or all of the above-mentioned problems or achieve part or all of the above-mentioned effects. Any of these technical features, if not explained as essential in the present specification, may be eliminated as appropriate.

DESCRIPTION OF REFERENCE NUMERALS

10: Spark plug
90: Internal combustion engine
100: Center electrode
101: Front end face
107: Peripheral surface

110: Electrode base
111: End face
117: Peripheral surface
130: Fused part
131: Exposed surface
132: Constricted section
133, 135: Boundary surface
139: End region
150: Electrode tip
151: End surface
157: Peripheral surface
190: Metal terminal
200: Insulator
290: Axial hole
300: Metal shell
310: End face
400 to 409: Ground electrode
410: Electrode base
411, 412, 413, 415, 416: Base surface
418: Recess
430, 430D: Fused part
431: Exposed surface
432: Constricted section
433, 435: Boundary surface
439: End region
440: Fused part
450, 450A, 450B, 450C, 450D: Electrode tip
451, 453, 454: Tip surface
910: Inner wall
920: Combustion chamber Having described the invention, the following is claimed:

1. A spark plug, comprising:

a first electrode; and a second electrode including an electrode base, an electrode tip joined to the electrode base so as to define a gap between the first electrode and the electrode tip, and a fused part formed between the electrode tip to the electrode base and joining the electrode tip to the electrode base, wherein the electrode tip has a flat surface located apart from the electrode base, wherein the fused part is joined to the electrode tip at a side of the electrode tip opposite to the flat surface in a plane direction from one end of the flat surface to another end of the flat surface, and wherein a cross-sectional shape of the fused part taken along a plane perpendicular to the flat surface and parallel to the plane direction has a constricted section at a position between one side of the cross-sectional shape of the fused part and another side of the cross-sectional shape of the fused part in the plane direction, the constricted section being defined by a depression in the cross-sectional shape of the fused part.

2. The spark plug according to claim 1, wherein the fused part has an exposed surface to which a laser beam is emitted and satisfies a relationship of $A/B \geq 0.5$ where A is a minimum width of the cross-sectional shape in a direction perpendicular to the plane direction as measured at the constricted section; and B is a maximum width of the cross-sectional shape in the direction perpendicular to the plane direction as measured at a point further apart from the exposed surface than a point of the constricted section at which the minimum width A is measured.

3. The spark plug according to claim 1, wherein the fused part has an exposed surface to which a laser beam is emitted, and wherein at least one point of the constricted section at which the cross-sectional shape has a minimum width in a direction perpendicular to the plane direction is located closer to the exposed surface than an imaginary line which divides a length of the cross-sectional shape in the plane direction into two equal halves.

4. The spark plug according to claim 1, wherein the flat surface faces the first electrode with the gap defined between the flat surface and the first electrode; and wherein the fused part is formed avoiding the flat surface.

5. The spark plug according to claim 1, wherein the fused part has an exposed surface to which a laser beam is emitted; and wherein a center of gravity of the cross-sectional shape is located closer to the exposed surface than an imaginary line which divides a length of the cross-sectional shape in the plane direction into two equal halves.

6. The spark plug according to claim 1, wherein the second electrode is at least one of a center electrode and a ground electrode.

7. The spark plug according to claim 1, wherein the fused part is a weld.

8. A spark plug, comprising:

a first electrode; and a second electrode including an electrode base, an electrode tip joined to the electrode base so as to define a gap between the first electrode and the electrode tip, and a fused part joining the electrode tip to the electrode base, wherein the electrode tip has a flat surface located apart from the electrode base, wherein the fused part is joined to the electrode tip at a side of the electrode tip opposite to the flat surface in a plane direction from one end of the flat surface to another end of the flat surface, wherein a cross-sectional shape of the fused part taken along a plane perpendicular to the flat surface and parallel to the plane direction has a constricted section at a position from one side of the cross-sectional shape of the fused part to another side of the cross-sectional shape of the fused part in the plane direction, wherein the fused part has an exposed surface to which a laser beam is emitted, and wherein at least one point of the constricted section at which the cross-sectional shape has a minimum width in a direction perpendicular to the plane direction is located closer to the exposed surface than an imaginary line which divides a length of the cross-sectional shape in the plane direction into two equal halves.

9. A spark plug, comprising:

a first electrode; and a second electrode including an electrode base, an electrode tip joined to the electrode base so as to define a gap between the first electrode and the electrode tip, and a weld joining the electrode tip to the electrode base, wherein the electrode tip has a flat surface located apart from the electrode base, wherein the weld is joined to the electrode tip at a side of the electrode tip opposite to the flat surface in a plane direction from one end of the flat surface to another end of the flat surface, wherein a cross-sectional shape of the weld taken along a plane perpendicular to the flat surface and parallel to the plane direction has a constricted section at a position between one side of the cross-sectional shape of the weld and another side of the cross-sectional shape of the weld in the plane direction, and wherein the constricted section is defined by a region at which a width of the cross-sectional shape in a direction perpendicular to the plane direction is smaller in the plane direction compared to regions on either side of the constricted section in the plane direction.

* * * * *